US005865249A

United States Patent [19]

Gipson et al.

[11] Patent Number: 5,865,249

[45] Date of Patent: Feb. 2, 1999

[54] METHOD AND APPARATUS FOR WASHING A HORIZONTAL WELLBORE WITH COILED TUBING

[75] Inventors: Larry J. Gipson, Anchorage, Ak.; John C. Patterson, Garland, Tex.

[73] Assignee: Atlantic Richfield Company, Los Angeles, Calif.

[21] Appl. No.: 838,901

[22] Filed: Apr. 11, 1997

[51] Int. Cl.[6] ..... E21B 37/00

[52] U.S. Cl. ..... 166/312; 166/50; 166/222

[58] Field of Search ..... 166/312, 50, 222

[56] References Cited

U.S. PATENT DOCUMENTS

| | | | |
|---|---|---|---|
| 3,464,495 | 9/1969 | Childers et al. | 166/312 |
| 4,116,275 | 9/1978 | Butler et al. | 166/50 |
| 4,909,325 | 3/1990 | Hopmann | 166/312 |
| 5,090,481 | 2/1992 | Pleasants et al. | 166/312 |
| 5,291,947 | 3/1994 | Stracke | 166/187 |
| 5,400,856 | 3/1995 | Schmidt | 166/271 |
| 5,447,200 | 9/1995 | Dedora et al. | 166/312 |
| 5,462,118 | 10/1995 | Jennings, Jr. et al. | 166/312 |
| 5,607,018 | 3/1997 | Schuh | 166/50 |

OTHER PUBLICATIONS

SPE 30269 "Horizontal Well Sand Cleanouts", B.D. Heinrichs et al, Society of Petr. Engr; presented @ Calgary, Alberta, Canada, 19–21 Jun., 1995.

*Primary Examiner*—Hoang C. Dang
*Attorney, Agent, or Firm*—Drude Faulconer

[57] ABSTRACT

A method and apparatus for removing solids from a substantially horizontal section of a wellbore which allows the use of coiled tubing as a workstring without requiring the removal of the production tubing from the wellbore. Guide tubing, which is left in the wellbore, extends from the surface through the horizontal section and is adapted to guide a string of slightly smaller-diameter, coiled tubing through the horizontal section. Wash fluid, e.g. water, flows through a nozzle on the coiled tubing and out through openings in the guide tubing directly into the solids to form a slurry therewith. The slurry is then pumped out of the wellbore through the production tubing and/or reenters the guide tubing through other opening(s) therein to flow to the surface through the annulus which exists between the coiled tubing and the guide tubing.

10 Claims, 2 Drawing Sheets

METHOD AND APPARATUS FOR WASHING A HORIZONTAL WELLBORE WITH COILED TUBING

DESCRIPTION

1. Technical Field

The present invention relates to a method and apparatus for washing a horizontal wellbore with a coiled tubing and in one of its aspects relates to a method and apparatus for washing solids (e.g. sand) from a substantial length of a horizontal wellbore with a coiled tubing which is lowered through a guide tubing string which is positioned and left in the horizontal section of the wellbore.

2. Background Art

When producing hydrocarbons or the like from subterranean formations, it is common to use inclined, high-angle wells and/or horizontal wells to maximize the production from certain of these formations. As will be understood in the art, an "inclined, high-angled" well is one wherein at least the portion of the well which passes through the production formation is drilled at a high-angle with the respect to the vertical while a "horizontal" well is one which may be drilled vertically from the surface and then diverted approximately 90° as it approaches the production formation whereby the lower end of the wellbore extends substantially horizontally within the formation. As used herein, "horizontal" wellbore is intended to refer to both of these types of wells.

During the production of the hydrocarbons, solids (e.g. sand) are routinely produced along with the fluids from the formations. While this is always a problem regardless of the type of wellbore being used, it is a particularly serious problem in horizontal wellbores. This is due to the lack of any substantial grade within these substantially horizontal wellbores. Accordingly, the produced solids have a tendency to settle out and accumulate within the horizontal wellbore and, if these solids are not removed at proper intervals, they can seriously impede, if not eliminate all together, the production through the wellbore.

Presently, when the production rate of a well drops below an acceptable level due to "sanding-up" of the wellbore, the well has to be shut in and "worked-over" before adequate production can be restored. This is typically done by pulling the string of production tubing from the wellbore and then lowering a wash tool on a workstring to wash the sand from the wellbore. Since the production tubing has to be pulled from and re-run into wellbore, a considerable amount of expense and downtime is involved in such a workover.

To alleviate some of the costs involved, many operators now use "coiled tubing" as the workstring in such workovers. "Coiled tubing" is basically a continuous length of relatively small diameter conduit which can be payed off and wound onto a large-diameter reel. Being of a continuous length, no joints of pipe have to be "made-up" or "broken-out" as the coiled tubing is run into and out of the wellbore thereby saving time, money, and manpower.

Unfortunately, however, the use of coiled tubing has been severely limited in working over high-angled and/or horizontal wellbores. This is due in part to the size and flexibility of the coiled tubing, itself; i.e. the small-diameter coiled tubing has a tendency to spiral or "corkscrew" as it is pushed into the much larger-diameter horizontal portion of the wellbore. This corkscrew effect can prevent the coiled tubing from moving further through the wellbore and can pinch and bind the coiled tubing so as to render it ineffective as a wash string.

Recently, it has been proposed to position a string of guide tubing in the wellbore along side the production tubing and then lower a string of coiled tubing through the guide tubing to carry out a wash operation in the wellbore; see "HORIZONTAL WELL SAND CLEANOUTS", B. D. Heinrichs et al, SPE 30269, presented at Calgary, Alberta, Canada, 19–21 Jun., 1995. However, the guide tubing extends only through the vertical portion of the wellbore and terminates substantially adjacent the lower end of the production tubing which, in turn, lies at or near the entrance of the horizontal portion of the well.

This technique would appear to work well in allowing the coiled tubing to more easily traverse the vertical portion of the wellbore while cleaning sand from around and near the lower end of the production tubing. However, the coiled tubing will experience many of the same problems as before after it exits the guide tubing and is pushed into the horizontal portion of the wellbore. That is, the small-diameter coiled tubing will again become subject to "corkscrewing" as it is pushed through the much larger-diameter, horizontal portion of the wellbore. Also, where large amounts of sand have accumulated within the horizontal portion of the wellbore, the coiled tubing must be advanced very slowly, if it can be advanced at all, in order to prevent the "returns" (i.e. washed-sand) from plugging the downhole pump and to prevent the coiled tubing from becoming stuck in the horizontal portion of the wellbore.

SUMMARY OF THE INVENTION

The present invention provides a method and apparatus which allows coiled tubing to be used to wash solids from long lengths of substantially horizontal wellbores without "corkscrewing" or becoming stuck within the horizontal wellbore. This can be done without removing the production tubing from the wellbore. The present invention is carried out by "permanently" positioning a string of guide tubing in said wellbore which extends from the surface not only through the vertical section of a wellbore but into and substantially through the horizontal portion of said wellbore. Once the guide tubing is in place within the wellbore, it remains there and is not removed under normal circumstances.

The guide tubing is adapted to receive and guide a string of coiled tubing through the horizontal wellbore where the coiled tubing has a diameter which is only slightly smaller than the diameter of the guide tubing, itself. The guide tubing has a plurality of openings (e.g. elongated slots) spaced along that portion which extends substantially through the horizontal portion of the wellbore. These openings are sized to allow the flow of both solids and fluid into and out of the guide tubing. A jet nozzle is carried on the lower end of the coiled tubing to increase the pressure, hence the washing action, of the wash fluid as it exits the coiled tubing.

In operation, when the production from a particular well drops below an acceptable rate due to sanding, the well is shut-in and coiled tubing is lowered through the guide tubing. Since the guide tubing is "permanently" positioned in the well, there is no need to pull the production tubing and downhole pump during the wash operation. As the coiled tubing approaches the lower portion of the guide tubing which lies within the horizontal portion of the wellbore, a wash fluid, e.g. water, is flowed down through the coiled tubing and out the nozzle. The wash fluid flows into the guide tubing and out through the openings therein to agitate the accumulated sand adjacent the openings and form a slurry therewith.

This slurry is then removed from the wellbore by (a) using the downhole pump to lift the slurry to the surface through the production tubing which remains in place during the wash operation and/or (b) flowing the slurry back into the guide tubing through other of the openings therein and up to the surface through the annulus which is formed between the coiled tubing and the guide tubing.

It can be seen that by providing a "permanent" guide tubing throughout the entire wellbore, the coiled tubing can readily pass through the wellbore, including all of the horizontal portion thereof, without "corkscrewing" or binding therein. Further, by providing spaced openings along at least the horizontal portion of the guide tubing, wash fluid which flows from the coiled tubing can be applied directly to the accumulated solids within the horizontal portion to aid in agitating the solids and in forming a slurry therewith by which the solids are removed. Still further, since the guide tubing remains in the well, the production tubing and pump does not have to be removed and replaced each time a wash operation is carried out.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
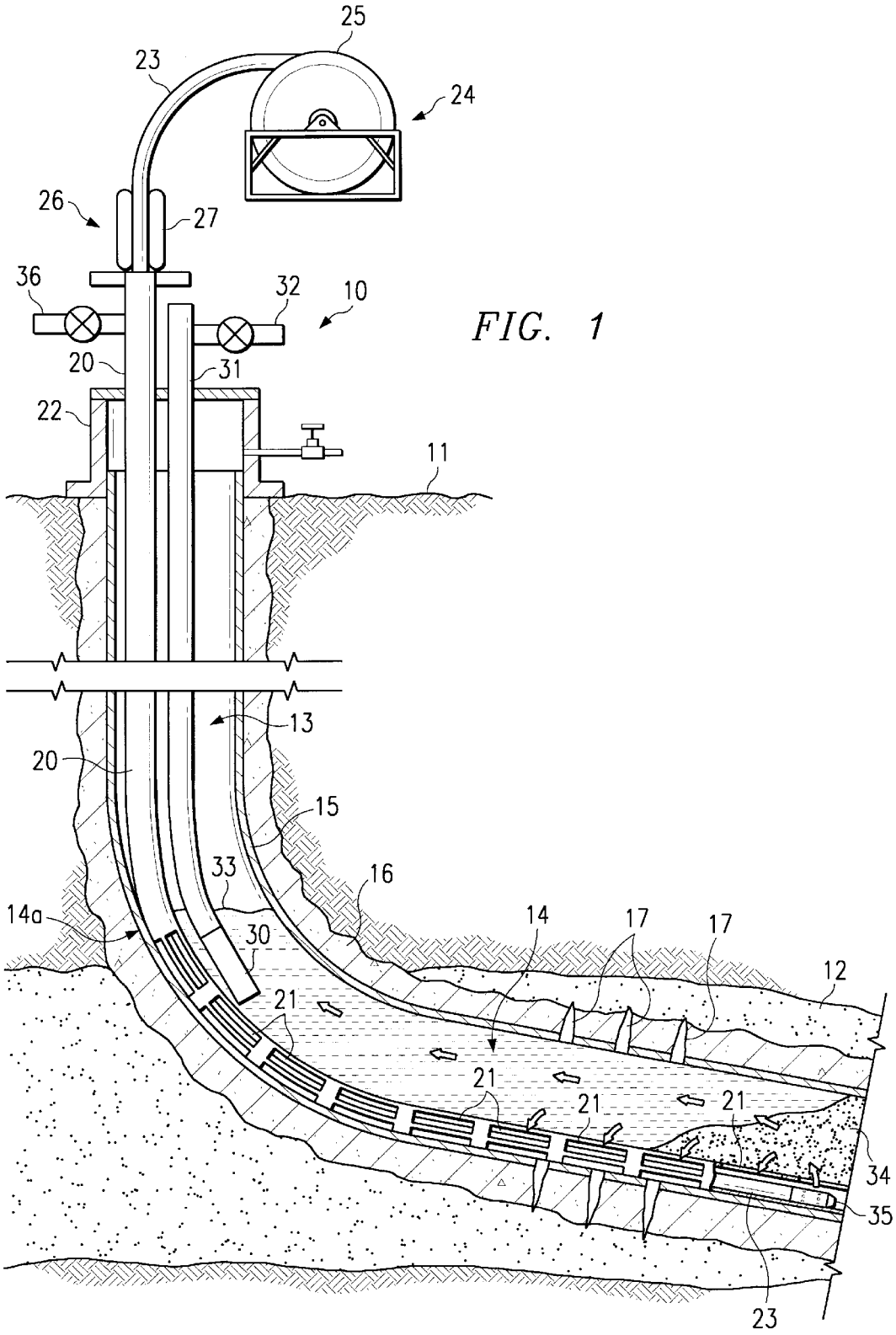
FIG. 1 is an elevational view, partly in section, of a horizontal well which has been completed in accordance with the present invention and in which a wash operation is being carried out.
Figure 2:
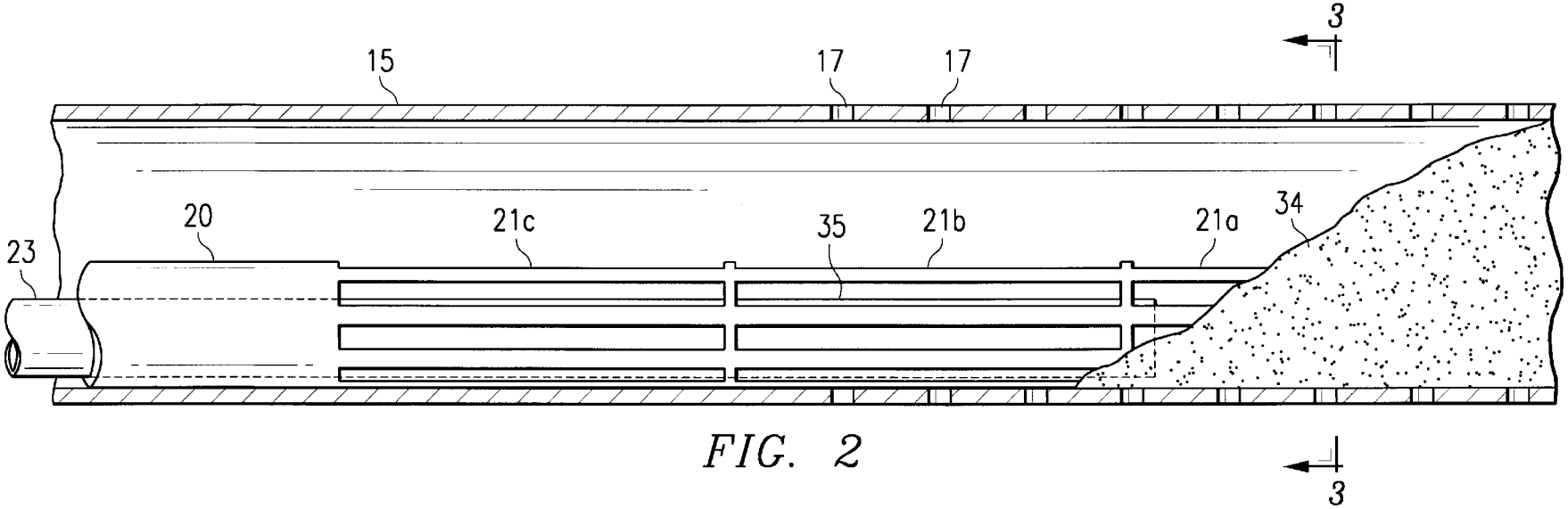
FIG. 2 is an, enlarged elevational view of a "sanded-up" portion of the horizontal wellbore of FIG. 1.

Referring more particularly to the drawings, FIG. 1 illustrates a "horizontal well" 10 which has been drilled from the surface 11 into a subterranean, producing formation 12. As shown, well 10 has a substantially vertical section 13 which is drilled downward from surface 11 to a point where the wellbore approaches formation producing 12. Using well known drilling techniques, the wellbore is then diverted through approximately 90° and drilling is continued to provide the wellbore with a substantially horizontal section 14 which extends into formation 12.

Horizontal section 14 can be completed "open-hole", completed with a liner or the like, or, as shown, can be cased with standard well casing 15 which, in turn, is cemented in place by cement 16, as is common in the art. When the wellbore is cased, as shown, casing 15 and cement 16 are perforated to provide openings 17 into formation 12 through which fluids are produced from formation 12 into the horizontal section 14 of the wellbore.

While horizontal well 10 is illustrated in FIG. 1 as one having a wellbore comprised of a vertical section and a contiguous horizontal section, "horizontal well", as used herein, is intended to include all wells which have at least a portion of its wellbore highly-inclined from the vertical and is intended to include inclined, high-angle wells as well as wells which have at least a portion of the wellbore extending substantially horizontal into the producing formation.

Once well 10 has been completed, a string of guide tubing 20 is lowered through the vertical section 13 of the wellbore and is forced along the curvature of the wellbore into horizontal section 14. Tubing 20 is comprised of a durable material, e.g. steel, and is preferably comprised of commercially-available tubing such as that commonly used for production tubing. A plurality of openings 21 (e.g. perforations, elongated slots, etc.) are spaced along that portion of guide tubing 20 which extends throughout horizontal section 14, beginning approximately at the entrance 14*a* of horizontal section 14. Preferably, the uppermost openings lie substantially adjacent the inlet of pump 30 on production string 31. The purpose of these openings will be discussed below.

The upper end of guide tubing 20 is accessible through wellhead 22 and is adapted to receive coiled tubing 23 from coiled tubing unit 24. Coiled tubing units are well known in the art and are commercially-available in many areas where hydrocarbons are produced. While such units may vary somewhat in actual construction, a typical coiled tubing unit 24 includes a reel 25 and an injector head 26 which are mounted on a motor vehicle (not shown) so that the unit can easily and quickly be moved between sites. Injector head 26 normally includes track means 27 which grip and feed a continuous length of steel, coiled tubing 23 from the reel 25 into the wellbore through a standard blow-out preventor and/or stuffing box (not shown) on the wellhead, as will be fully understood in the art.

Guide tubing 20 is positioned in the wellbore and is normally left there throughout the production life of the well. That is, guide tubing 20 will not be removed from the wellbore under normal circumstances during the production life of the well.

The well 10 may then be finally completed by lowering the string of production tubing 31 into the vertical section 13 of the wellbore. This can be done before guide tubing 20 is positioned but preferably, is done after guide tubing 20 is in place. The production tubing carries a pump 30, if needed, at its lower end which is to be positioned at or near the entrance 14*a* of the horizontal section 14. Pump 30 can be a standard, downhole, pump which is operated by a submersible, downhole electric motor or by a string of sucker rods (not shown) which extend up through production tubing 31. Pumps which are capable of handling a mixed flow of fluids and solids); e.g. progressive cavity pumps, are commonly used in wells of this type.

As will be understood, when well 10 is put on production, fluids (e.g. crude oil, natural gas, water, etc.) will flow through perforations 17 from formation 12 into horizontal section 14 of the wellbore where the fluids accumulate until they reach a level 33 in vertical section 13 which, in turn, acts as a sump for pump 30. The fluids then flow or are pumped up through production tubing 31 by pump 30 to the surface where they exit through outlet 32.

Unfortunately, as will be understood in the art, in a large number of wells, solid, particulate materials (e.g. sand 34) are routinely produced into the wellbore along with the production fluids. Due to the grade of horizontal section 14, gravity will normally cause large amounts of these solids to settle out of the produced fluids onto the low side of horizontal section 14 where they continue to accumulate during production. Eventually, these solids 34 will fill the wellbore in section 14 to an extent where further production from formation 12 is blocked or is sufficiently impeded to drop production below an acceptable rate.

When this occurs, the well has to be shut in and worked over in order to remove these solid and thereby restore the production rate to an acceptable level. In accordance with the present invention, production tubing 31 and pump 30 do not need to be removed as has been the case in most prior art work-over operations. Instead, injector head 26 of coiled tubing unit 24 is aligned with guide tubing 20 and coiled tubing 23 is fed down guide tubing 20. Coiled tubing 23 carries a jet nozzle 35 or the like at its lower end for a purposed described below.

The flexible, coiled tubing 23 has a slightly smaller diameter (e.g. 1¼ inch) than that of guide tubing 20 (e.g. 2⅜ inch) whereby the coiled tubing is physically guided through the guide tube. The small difference in diameters does not allow the coiled tubing to spiral or corkscrew as it is pushed through the guide tube 20 but does provide an annulus between the two large enough to allow flow therethrough.

As illustrated, openings 21 in the lower portion of guide tubing 20 are relatively large (e.g. 3 to 6 inches long by ½ inch wide elongated slots) in order to allow both fluid (e.g. water) and particulates (e.g. sand) to flow into and out of guide tubing 20. If any solids pass through slots 21 during production and accumulate within guide tubing as they accumulate within horizontal section 14, these solids can quickly be washed therefrom by nozzle 35 through slots 21 as coiled tubing 23 is advanced through the horizontal portion of the guide tubing 20.

Figure 3:
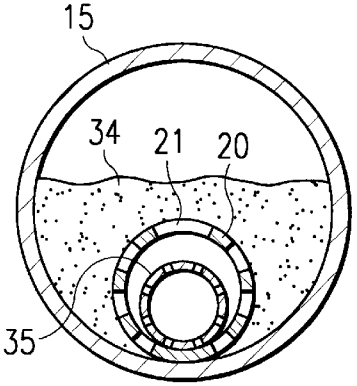
FIG. 3 is a sectional view, not to scale, taken along section line 3—3 of FIG. 2.

As coiled tubing 23 is advanced within guide tubing 20, a wash fluid (e.g. water) is flowed down coiled tubing 23 and out nozzle 35. This wash fluid will pass through the respective slots 21 which lie adjacent respective accumulated solids to agitate those accumulated solids 34 and create a slurry or the like therewith. This slurry may then wash back along guide tubing 20 within horizontal portion 14 of the wellbore until it reaches pump 30. If pump 30 is a pump capable of handling solids, the slurry of wash fluid and solids can be pumped up production tubing 31 to the surface where it can be properly disposed of. If the pump is one which can not handle solids or even if the pump can, the slurry of solids created by fluid flowing out of respective "forward" slot(s) (e.g. 21*a* in FIG. 3) and is removed from the wellbore through respective "rearward" slot(s) (e.g. 21*b*, 21*c*, etc. in FIG. 3).

That is, the wash fluid passes from nozzle 35 and through a set of adjacent slots directly into the accumulated solids to stir up the solids and form a slurry therewith. This slurry, if not capable of being pumped by pump 30, will build up pressure in the annulus around guide tubing 20 and will pass back into the guide tube through the rearward slots and will flow back to the surface through the annulus which exists between coiled tubing 23 and guide tubing 20 to be removed through outlet 36.

It can be seen that by providing a "permanent" guide tubing 20 in the wellbore, it is always available for guiding a coiled tubing wash strings down the well and into the horizontal portion 14 of the wellbore. Once the guide tubing has been placed, nothing has to be installed in the well each time a wash operation needs to be carried out. Further, the production tubing and pump does not need to be removed and replaced in order to perform a wash operation in the well. Still further, the coiled tubing can be pushed through the entire horizontal section of the wellbore without undergoing "corkscrewing" or binding therein while the wash fluid is applied directly through the spaced openings in the guide tubing to the accumulated solids therein.

What is claimed is:

1. A method for removing accumulated solids from a substantially horizontal section of a wellbore, said method comprising:

positioning a production tubing within said wellbore for producing fluids therethrough;

positioning a guide tubing in said wellbore substantially parallel to said production tubing and extending from the surface and substantially through the entire said horizontal section of said wellbore;

lowering a coiled tubing through said guide tubing; and flowing a wash fluid down said coiled tubing to wash said solids from said horizontal section of said wellbore as said coiled tubing moves through said guide tubing.

2. The method of claim 1 wherein said wash fluid flows down said coiled tubing and out through at least one respective forward opening in that portion of said guide tube which extends through said horizontal section of said wellbore whereby said fluid is applied directly to said accumulated solids.

3. The method of claim 2 wherein said wash fluid forms a slurry with said accumulated solids and said slurry is removed by flowing through at least one respective rearward opening in said guide tubing and then up to the surface through the annulus formed between said coiled tubing and guide tubing.

4. The method of claim 3 wherein said wash fluid forms a slurry with said accumulated solids and said slurry is removed by pumping said slurry to the surface through said production tubing.

5. The method of claim 2 wherein said guide tubing is left in position within said wellbore after said solids are removed and said coiled tubing is removed from said guide tubing.

6. In a well having a wellbore with a substantially vertical section and a substantially horizontal section, an apparatus for removing solids form said substantially horizontal section of the wellbore of the well, said apparatus comprising:

a guide tubing extending from the surface, through said substantially vertical section, and into and substantially through said substantially horizontal section of the wellbore; said guide tubing being adapted to receive and guide a string of coiled tubing down said wellbore and into said substantially horizontal section of said wellbore, said guide tube having a plurality of openings spaced along that portion of said guide tube which extends into and through said substantially horizontal section of said wellbore, said openings being sized to allow the flow of both solids and fluid into and out of said guide tubing;

a string of production tubing extending from the surface to near the entrance of said substantially horizontal section of said wellbore; and a string of coiled tubing adapted to be lowered and raised through said guide tubing.

7. The well of claim 6 wherein said openings are in the form of elongated slots.

8. The well of claim 6 wherein said openings are in the form of perforations.

9. The well of claim 6 including:

a nozzle on the lower end of said string of coiled tubing.

10. The well of claim 6 including:

a pump on the lower end of said production tubing.

* * * * *